United States Patent [19]

Dorma

[11] 3,979,977

[45] Sept. 14, 1976

[54] POWER TOOL

[76] Inventor: Edward Dorma, 4333 Grimes Ave. N., Minneapolis, Minn. 55422

[22] Filed: June 16, 1975

[21] Appl. No.: 587,422

[52] U.S. Cl. ..... 81/57.13; 81/57.29; 81/58.2; 81/90 C

[51] Int. Cl.[2] ..... B25B 17/00

[58] Field of Search.. 81/57.29, 57.13, 57.15–57.21, 81/90 C, 58.2; 29/240

[56] References Cited

UNITED STATES PATENTS

| | | | |
|---|---|---|---|
| 2,550,045 | 4/1951 | DeHetre | 81/57.18 |
| 2.556,536 | 6/1951 | Harris | 81/57.18 |
| 3,196,717 | 7/1965 | Sheppard | 81/57.2 |
| 3,216,099 | 11/1965 | Boss | 81/90 C |
| 3,257,877 | 6/1966 | Ulrich et al. | 81/57.13 |
| 3,620,105 | 11/1971 | Batten | 81/58.2 |

*Primary Examiner*—James L. Jones, Jr.
*Attorney, Agent, or Firm*—Burd, Braddock & Bartz

[57] ABSTRACT

A power tool for applying a rotational force to a spring of a door counterbalancing mechanism. The power tool has a rotatable drive member mounted on a casing carrying a power transmitting structure. The drive member has a slot with an open end for accommodating the shaft of the counterbalancing mechanism. A releasable coupling structure drivably connects the drive member with the collar attached to the spring so that rotation of the drive member will apply rotational force to the spring. A motor connected to the power transmitting structure is operable to rotate the drive member. A socket adapter or pipe adapter can be connected to the drive member so that the power tool is usable to rotate nuts, bolts and pipes.

36 Claims, 13 Drawing Figures

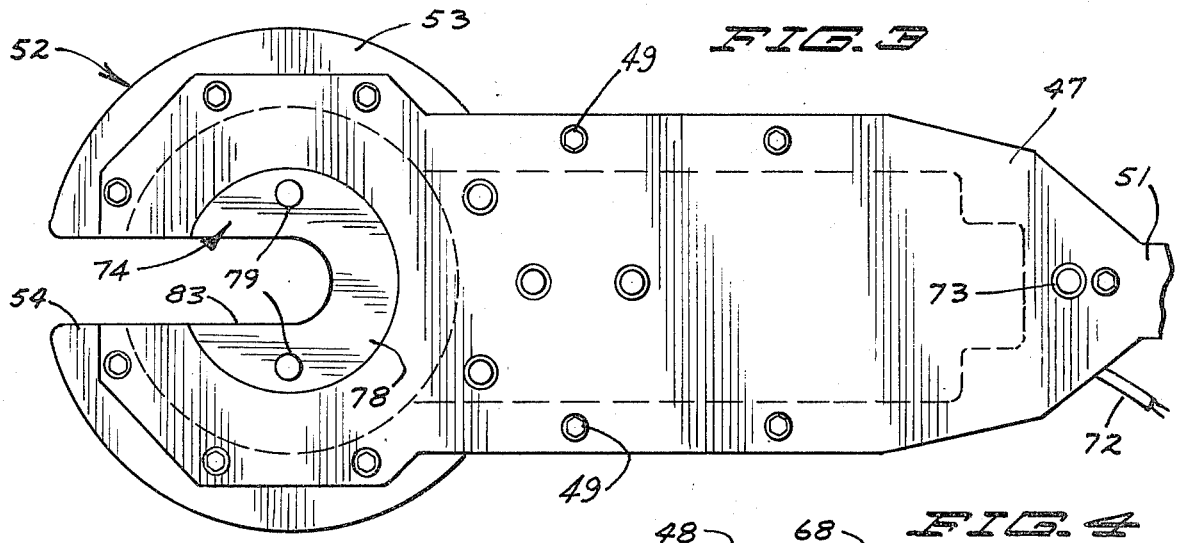
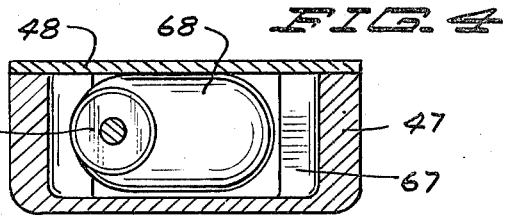
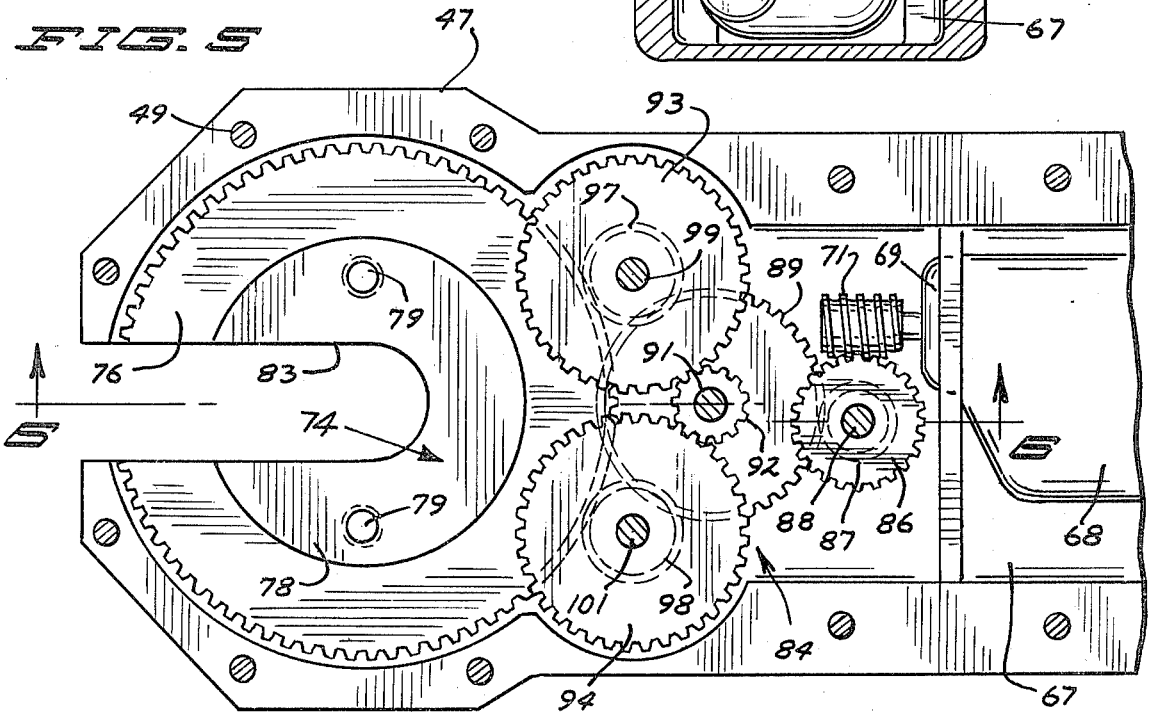
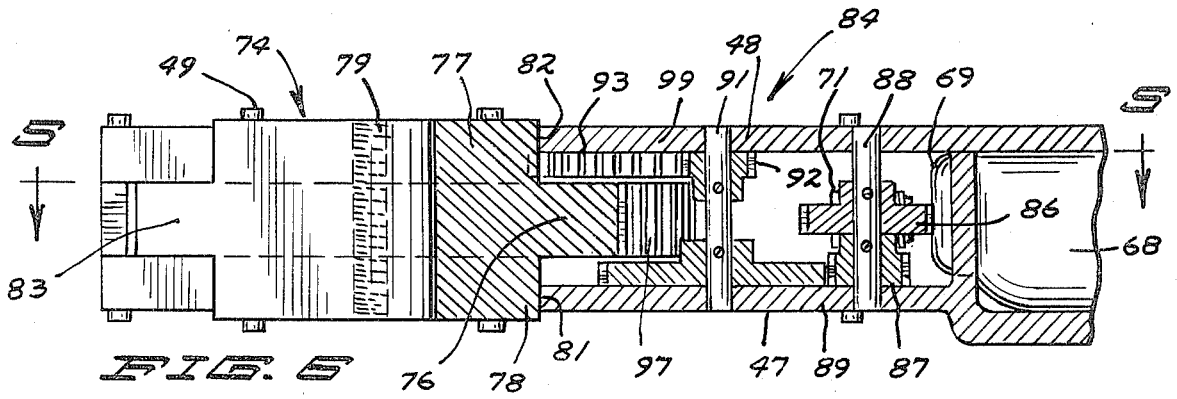
FIG. 6

POWER TOOL

BACKGROUND OF INVENTION

Power tools, as air wrenches and electric wrenches, are used to rapidly turn nuts, bolts, and screws. These tools are not usable to apply twisting forces to the springs of a counterbalancing mechanism of a door, such as an overhead garage door. The counterbalancing mechanisms of overhead garage doors utilize coil springs that are placed under a rotational or torsion force to apply a lifting force to the door. The springs are concentrically positioned about a shaft rotatably mounted on fixed supports. The shaft carries hubs accommodating cables. The cables are attached to the door so that when the hubs are rotated, a lifting force will be applied to the door. The lifting force is transmitted to the hubs via the shaft by the torsion springs. The spring must be twisted to load the spring or place the spring under torsion force. Heretofore, long rods have been used to turn the collar attached to the spring to load the spring. This usually requires two men. A limited amount of force can be applied to the spring since twisting the collar is a manual operation. The procedure requires a considerable amount of time and can be dangerous as the spring is loaded with considerable force. The power tool of the invention obviates the disadvantages of a manual procedure to load the spring of a door counterbalancing mechanism.

SUMMARY OF THE INVENTION

The invention is related to an apparatus for applying rotational force to an object, as a nut threaded onto a bolt, the bolt, a pipe, and the collar attached to a spring of a door counterbalancing mechanism. More particularly, the apparatus is a power tool used to apply rotational force to a torsion coil spring of a door counterbalancing mechanism. The power tool has a casing with a slot to accommodate the shaft of the counterbalancing mechanism. The casing is attached to an elongated handle so that the operator can hold the power tool during rotation of the drive member. The handle can be located in engagement with a fixed support to prevent rotation of the casing during winding of the spring of the door counterbalancing mechanism. A rotatable drive member is rotatably mounted on the casing. The drive member has a slot to accommodate the shaft. Power transmitting means mounted on the casing are operable to continuously drive the drive member. A motor, as an electric motor, is used to apply power to the power transmitting means. The drive member is connected to the collar with coupling structure. One form of the coupling structure has a disc attached to the drive member. A plurality of pins are connected to the disc. The pins extend into radial holes in the collar and thereby drivably connect the collar with the drive member of the power tool. In one form of the invention, the motor is located within a chamber located within the casing. An alternate form of the drive mechanism between the drive member and the collar includes a plurality of keyhole slots in the side of the collar. A plurality of bolts having heads located in the keyhole slots drivably connect the drive member with the collar.

An object of the invention is to provide a power tool usable to apply torsion forces to the counterbalancing spring of a door counterbalancing mechanism which is safe and convenient to use and can be used by one person. A further object of the invention is to provide a power tool for applying twisting forces to the spring of a door counterbalancing mechanism that is operable, with a minimum of time and labor, to apply the torsion forces to the spring sufficient to counterbalance the door. Another object of the invention is to provide a power tool that includes a motor that is compact in construction, relatively lightweight and efficient in use to apply torsion forces to the spring of a door counterbalancing mechanism. Yet another object of the invention is to provide a reliable and versatile power tool that can be attached to a socket or pipe gripping mechanism. A still further object of the invention is to provide a power tool with a drive member having a slot to accommodate an object, as a shaft, so that the drive member can be concentrically located with the shaft whereby on rotation of the drive member rotational forces can be applied to a member mounted on the shaft. These and other objects and advantages of the invention are embodied in the following description of the preferrred embodiments of the invention.

IN THE DRAWINGS

FIG. 3 is a partial plan view of the back of the tool of FIG. 2;

FIG. 4 is a sectional view taken along line 4—4 of FIG. 2;

FIG. 5 is an enlarged sectional view taken along line 5—5 of FIG. 6;

FIG. 6 is a sectional view taken along line 6—6 of FIG. 5;

FIG. 13 is a plan view, with parts broken away, of a modification of the power tool of the invention.

Figure 1:
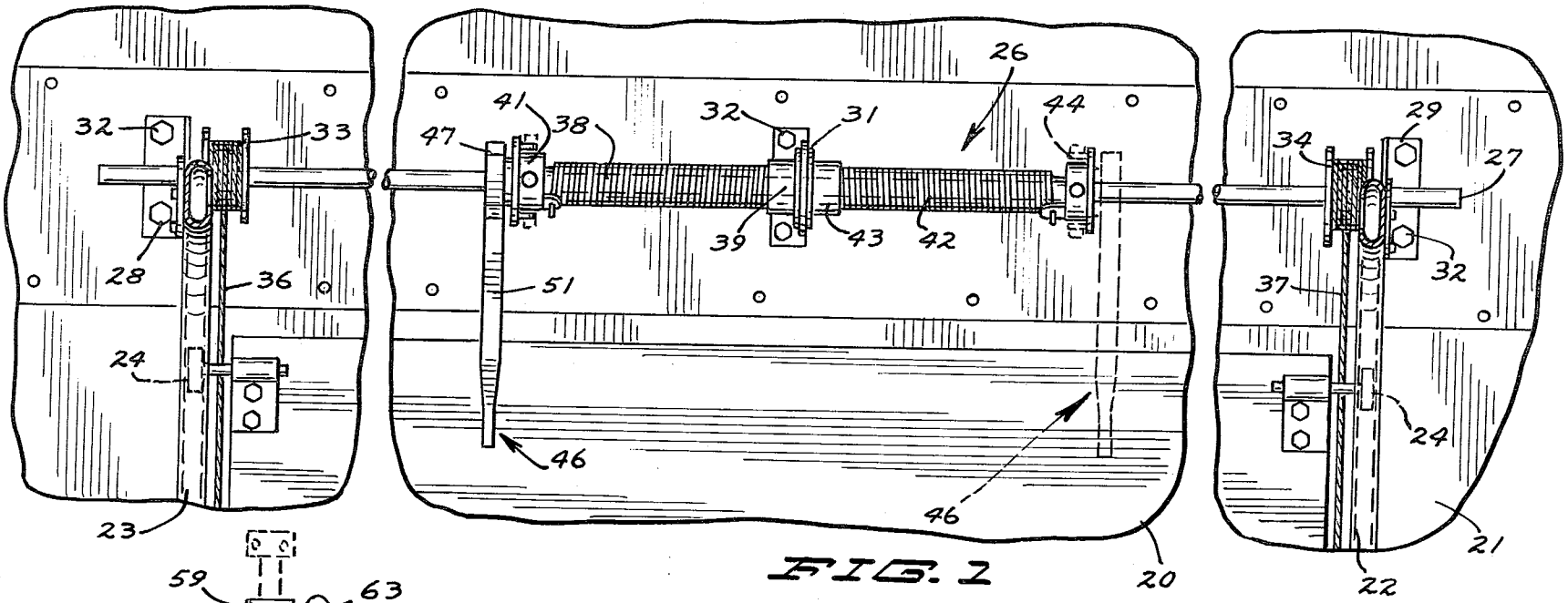
FIG. 1 is a fragmentary elevational view, partly sectioned, of a door counterbalancing mechanism and the power tool of the invention used to apply torsional or twisting forces to the counterbalancing springs of the mechanism.

DESCRIPTION OF PREFERRED EMBODIMENTS:

Referring to the drawing, there is shown in FIG. 1 an overhead door 20 in the closed position movably mounted on a structure 21, as a garage, warehouse or the like. Conventional tracks 22 and 23 having upright sections and generally horizontal sections are secured to the structure to movably support the door 20. A plurality of rollers 24 connected to separate portions of door 20 support the door on the tracks 22 and 23. The overhead door 20 is usually made of metal, plastic or wood panels and has considerable weight. A counterbalance mechanism indicated generally at 26 is used to facilitate opening the door 20 and retard or slow closing of the door.

Counterbalance mechanism 26 is located above the top of the door 20 and has a generally transverse shaft 27. Opposite end portions of shaft 27 are rotatably supported on support blocks 28 and 29. The midportion of shaft 27 is rotatably supported on a center support block 31. A plurality of fasteners 32 secure the blocks 28, 29 and 31 to the structure 21 located adjacent the top of door 20. In some installations, the shaft 27 is rotatably supported on the remote ends of the tracks 22 and 23. A first drum 33 carrying a cable 36 is secured to the left end of shaft 27. The lower end of cable 36 is connected with a suitable fastener (not shown) to the bottom of door 20. In a similar manner, a second drum 34 is fixed to the right end of shaft 27. A cable 37 wrapped around drum 34 extends downwardly and is attached to the lower end of door 20.

Figure 7:
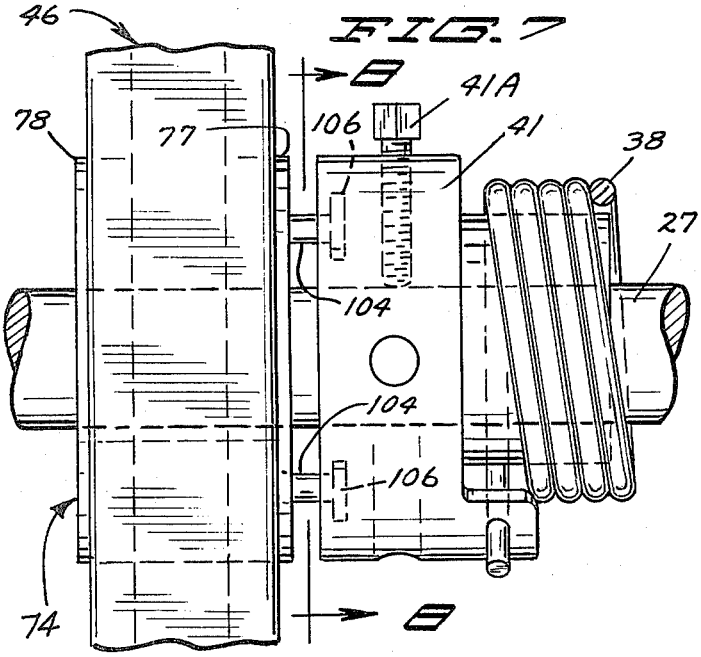
FIG. 7 is a fragmentary elevational view of a modification of the structure connecting the power tool with the spring collar of the door counterbalancing mechanism.

Shaft 27 is subjected to rotational or turning forces by a pair of coil or helical torsion springs 38 and 42. One end of spring 38 is secured to an anchor 39 attached to support block 31. The opposite end of spring 38 is connected to a collar 41. The collar 41 is fixed to the shaft 27 with suitable connecting means, such as set screws, bolts or the like. As shown in FIG. 7, a set screw 41A secures collar 41 to shaft 27. Screw 41A can be released so that collar 41 can be rotated relative to shaft 27 to twist spring 38. An anchor 43 secures one end of spring 42 to support block 31. The opposite end of spring 42 is connected to a collar 44. Collar 44 is secured to shaft 27 with fastening means, such as set screws, bolts or the like. In some installations, a single coil or helical torsion spring is used to apply the counterbalancing rotational force to shaft 27.

When the door is in its closed position, the springs 38 and 42 are fully energized by the twisting action of shaft 27. The shaft 27 rotates as the door 20 moves to its closed position, thereby subjecting springs 38 and 42 to twisting forces which store sufficient energy to counterbalance a substantial portion of the weight of the door 20. The springs 38 and 42 have sufficient energy so that a small amount of lifting force applied to door 20 will open the door. The springs 38 and 42 must be subjected to torsion forces when the door is open so that the springs will hold the door in the open position. The collars 41 and 44 must be rotated and fixed to shaft 27 is selected positions to apply twisting motions to the springs 38 and 42.

Prior to the present invention, the collars 41 and 44 were provided with a plurality of radially open bores to accomodate long rod-like tools. The rod-like tools were used to selectively hold and rotate the collars and thereby apply a twisting force to the springs. When sufficient force is applied to the springs, the collars 41 and 44 are anchored to the shaft 27. The tools used to rotate the collars 41 and 44 are released and removed from the collars so that the twisting force of springs 38 and 42 are transmitted via collars 41 and 44 to shaft 27. The power apparatus of the invention indicated generally at 46 is used to place the springs 38 and 42 under tension by turning the collars 41 and 44. Once the collars 41 and 44 are turned to selected positions, they are anchored on fixed to shaft 27.

Figure 2:
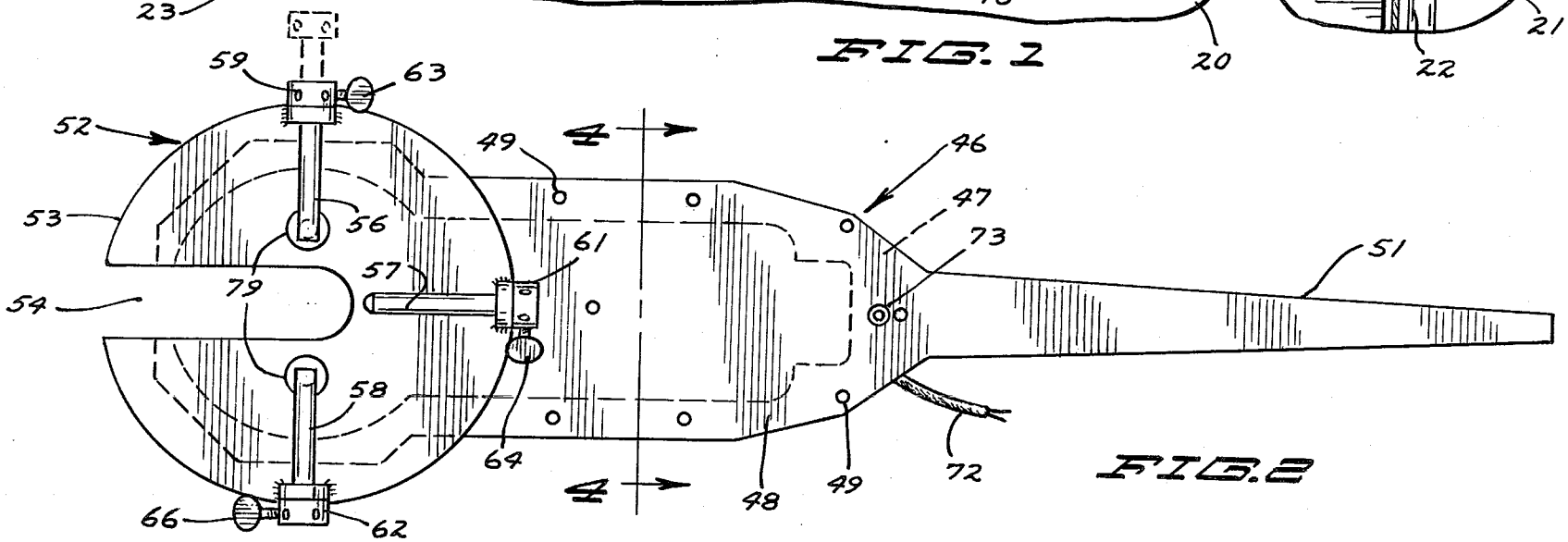
FIG. 2 is a plan view of the power tool of the invention.

Referring to FIG. 2, power apparatus 46 has an elongated casing comprising a body 47 carrying a cover plate 48. A plurality of bolts 49 secure plate 48 to body 47. An elongated handle 51 is integral with the outer or right end of body 47. A rotatable power transmitting means indicated generally at 52 is located adjacent the work or left end of body 47. The power transmitting means 52 includes a circular disc 53 having a radial slot 54. Three radial drive pins 56, 57 and 58 are mounted on the outer peripheral edge of disc 53 with separate sleeves 59, 61 and 62. The sleeves 59, 61, and 62 are secured by means of welds or the like to disc 53. The sleeves 59, 61 and 62 carry set screws 63, 64 and 66, respectively, which are used to fix the pins 56, 57 and 58 in their respective sleeves. Other types of fastening structures can be used to mount the pins in the sleeves. For example, spring biased pins can be associated with the sleeves whereby the springs will bias the pins to their "in" positions. In use, the pins 56, 57 and 58 extend into the radial holes of the collar 41 and thereby drivably connect the collar 41 to the power apparatus 46.

Referring to FIGS. 4, 5 and 6, body 47 has a chamber 67 accommodating an electric motor 68. Motor 68 has a gear head drive 69 having an output shaft carrying a worm gear 71. Motor 68 is connected to a power source with a cable or line 72. An on-off and reversing switch 73 is used to control the power to motor 68. Motor 68 can directly drive worm gear 71.

A rotatable drive member indicated generally at 74 is rotatably mounted on the forward end of housing 47 and cover plate 48. The drive member 74 is attached to the disc 52 with a plurality of bolts 79. Drive member 74 comprises a central spur gear 76 integrally joined to oppositely directed circular hubs 77 and 78. Bolts 79 are threaded into hubs 77 and 78 to connect disc 52 to one of the hubs. The hubs 77 and 78 have cylindrical external surfaces which are located in circular holes in the body 46 and the plate 47 whereby the hubs are journalled on the body 46 and plate 47. Suitable bearings can be used to journal hubs 77 and 78 in the fixed body 47 and plate 48. Rotatable member 74 has an elongated radial slot 83 of a size and length the same as slot 54.

A power transmission indicated generally at 84 transmits power from the worm gear 71 to spur gear 76. The power transmission 84 comprises a first gear 86 in driving engagement with worm gear 71. Gear 86 connected to a second smaller spur gear 87 with a shaft 88. Gear 87 is in driving engagement with a third gear 89. Gear 89 is mounted on a shaft 91 carrying a small fourth spur gear 92. As shown in FIG. 5, gear 92 is in driving engagement with a pair of fifth spur gears 93 and 94. Gear 93 drives a sixth gear 97 through a shaft 99. Gear 94 drives a sixth gear 98 through a shaft 101. Gears 97 and 98 are circumferentially spaced from each other a distance greater than the circumferential width of slot 83 so that one of the gears 97 or 98 is always in driving engagement with the teeth of gear 76. This permits gear 76 to continuously rotate when the open end of slot 83 sequentially moves past gears 97 and 98.

Figure 8:
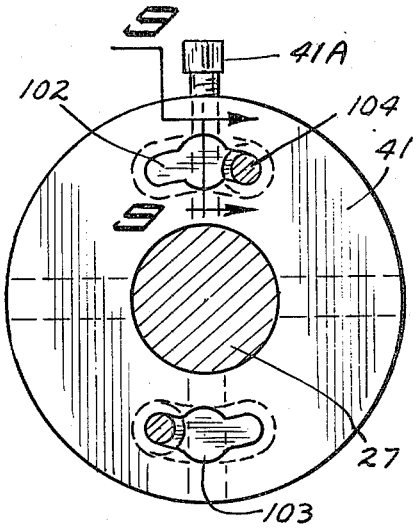
FIG. 8 is a sectional view taken along lines 8—8 of FIG. 7.
Figure 9:
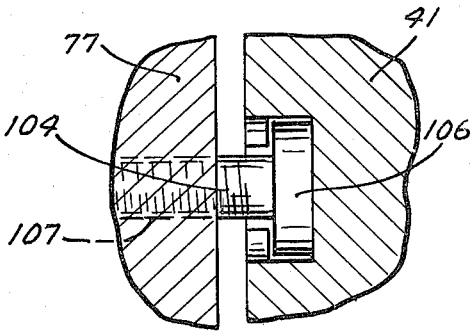
FIG. 9 is an enlarged sectional view taken along line 9—9 of FIG. 8.

Referring to FIGS. 7-9, there is shown a modification of the releasable connecting structure for drivably connecting the rotatable driving member of the power apparatus 46 to the collar 41. The collar 41 is provided with a pair of keyhole slots 102 and 103 in its outside face. The keyhole slots 102 and 103 are undercut and adapted to receive bolts 104. Each bolt 104 has a head 106 located in the base of the keyhole slot. The bolt 104 is threaded into a hole 107 in the hub 77. The undercut keyhole slots, in addition to providing a drive connection for the bolts 104, also hold the power apparatus 46 in driving and assembled relation with hub 41. In use, the hub set screw 41A is released so that the power apparatus 46 can be used to turn the hub 41. When hub 41 is turned, the spring 38 is placed under torsion so that it can apply a rotational force to the shaft 27 when the set screw 41A is turned down into firm engagement with shaft 27.

Figure 10:
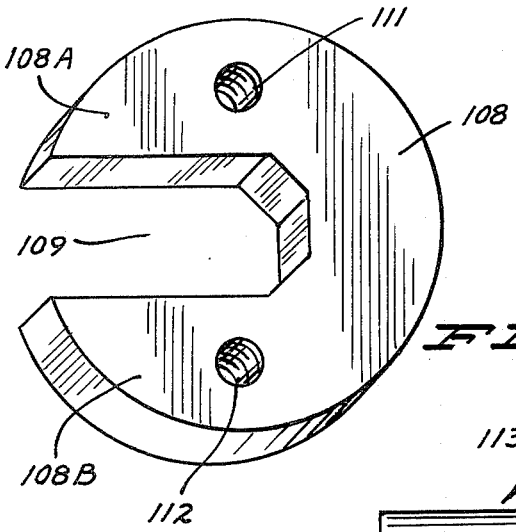
FIG. 10 is a perspective view of an open and wrench adapter usable with the power tool of the invention.

Referring to FIG. 10, there is shown an open end wrench adapter 108 for accommodating a nut or the head of a bolt. Adapter 108 has fixed side-by-side jaws 108A and 108B separated from each other to form an elongated mouth 109. The base of the mouth 109 is shaped to accommodate a hex member, such as a nut or the head of a bolt. A pair of holes 111 and 112 are located diametrically from each other along a line that is normal to the line bisecting the mouth 109. The holes 111 and 112 are aligned with the holes in the hub 77 so that connecting bolts can pass through holes 111 and 112 and be threaded into hub 77.

In use, the mouth 109 is aligned with the slot of the body. This permits the bolt and nut to be located in the base of the mouth 109. The motor 68 is operated so that the hub 77 will rotate the socket 108 and thereby turn the nut or bolt head located in mouth 109.

Figure 12:
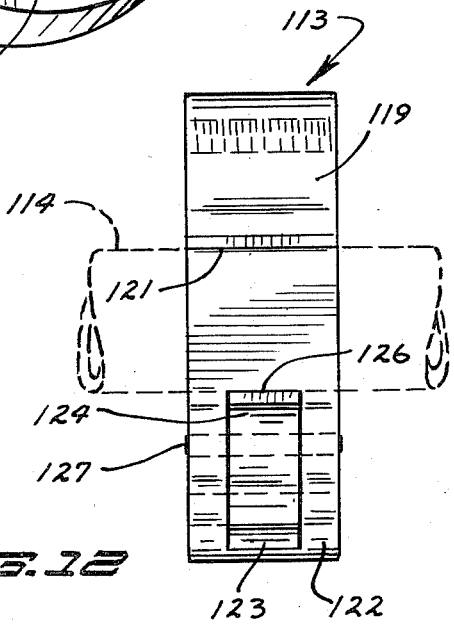
FIG. 12 is a side elevational view of the left side of FIG. 11.
Figure 11:
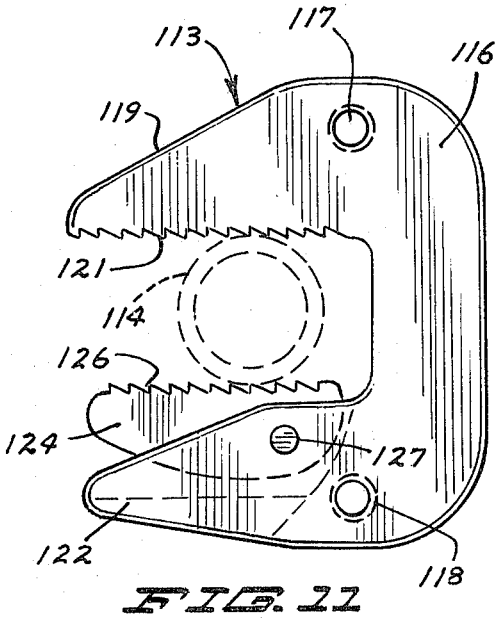
FIG. 11 is a plan view of a pipe wrench adapter usable with the power tool of the invention.
Figure 18:
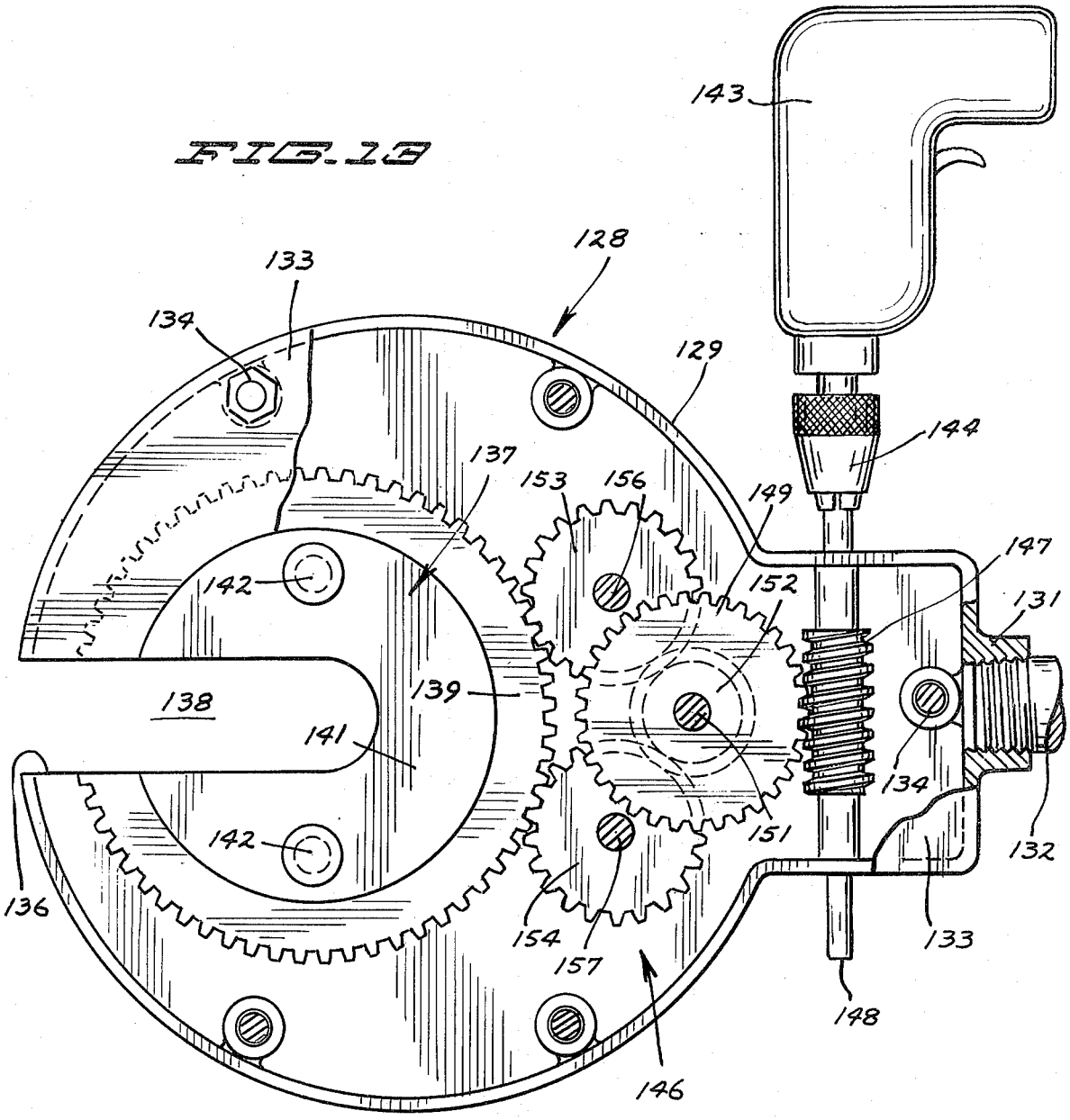

Referring to FIGS. 11 and 12, there is shown a pipe wrench adapter indicated generally at 113 for rotating a pipe 114. Pipe wrench adapter 113 has a generally U-shaped body 116 having a pair of holes 117 and 118. Holes 117 and 118 are laterally spaced from each other a distance to accommodate bolts (not shown) which are threaded into the hub 77.

Body 116 has a first jaw 119 having a series of inwardly sloping teeth 121 adapted to grip one side of pipe 114. Located opposite the first jaw 119 is a second jaw 122. Jaw 122 has an outwardly open pocket 123 accommodating a grip member 124. Grip member 124 has a series of outwardly facing teeth 126 adapted to grip pipe 114. A pivot pin 127 pivotally connects member 124 to jaw 122. In use, teeth 121 and 126 grip opposite portions of pipe 114 so that on rotation of adapter 113 the pipe 114 will be rotated. The grip member 124 can be mounted on adjusting structure, as a screw, so that the size of the mouth or space between teeth 121 and 126 can be adjusted to accommodate different sized pipes, rods or like circular members.

Referring to FIG. 13, there is shown a modification of the power apparatus of the invention indicated generally at 128. Apparatus 128 is used to apply rotational forces to the spring control collar of a counterbalancing mechanism for an overhead door in a manner shown in FIGS. 1-6 and 7-9. The nut and pipe adapter structures of FIGS. 10-12 can also be attached to the power apparatus 128.

Power apparatus 128 has a casing comprising body 129 and plate 133. Body 129 has a short boss 132. An elongated handle 132 is threaded into the boss 132. The body 129 has an upwardly directed peripheral flange forming a cavity or chamber. A cover plate 133 engages the flange and is attached to the body with a plurality of bolts 134. The body 129 and plate 133 have an outwardly open slot 136.

A rotatable drive member indicated generally at 137 is rotatably mounted on body 129 and cover plate 133. Member 137 has a slot 138 having substantially the same circumferential width as slot 136. Drive member 137 has a spur gear 139 and a pair of lateral circular hubs 141. The hubs are rotatably mounted on the body 129 and plate 133.

Each hub has a pair of threaded bores 142 for accommodating fasteners, such as bolts, to attach the drive mechanism to the drive member or drive bolts such as bolt 104, as shown in FIG. 9.

A portable externally located electric motor 143 is used to rotate the drive member 137. Electric motor 143 has a chuck 144, such as a Jacobs chuck, used to releasably attach the output drive member of the motor to a power transmission indicated generally at 146. The transmission 146 transmits the rotational power of motor 143 to rotational movement of the drive member 137.

Power transmission 146 comprises a transverse worm gear 147 fixed to a shaft 148. Shaft 148 is rotatably mounted on body 129. The chuck 144 can be releasably secured to either end of shaft 148. Worm gear 147 is in driving engagement with a first gear 149. Gear 149 is secured to a shaft 151 rotatably mounted on body 129 and plate 133. A second spur gear fixed to shaft 151 is in driving engagement with a pair of third gears 153 and 154. Gear 153 is fixed to shaft 156. In a similar manner, gear 154 is fixed to shaft 157. Both shafts 156 and 157 are rotatably mounted on body 129 and cover plate 133. Gears 153 aand 154 are circumferentially spaced from each other and have external spur gear teeth in meshing engagement with separate portions of the teeth of gear 139. The gears 153 and 154 are circumferentially spaced from each other a distance greater than the circumferential width of slot 138 so that one of the gears will be in driving engagement with gear 39 at all times. This permits the slot 138 to sequentially pass each gear without interrupting the rotational movement of drive member 137. The power transmitting structure 146 can be a concave worm gear in driving engagement with gear 139 in lieu of gears 147, 149, 152, 153 and 154.

While there have been shown and described preferred embodiments of the power apparatus of the invention, it is understood that changes in materials, size of the components, power transmission structures, coupling structures and other structures can be made by those skilled in the art without departing from the invention.

The embodiments of the invention in which an exclusive property or privilege is claimed are defined as follows:

1. An apparatus for applying rotational force to an object comprising: a casing, a rotatable drive member mounted on the casing, said drive member having a slot with an open end for accommodating a part, power transmitting means mounted on the casing for rotating the drive member, said power transmitting means adapted to be connected to a motor whereby on operation of the motor the power transmitting means rotates the drive member, and means connecting the drive member to the object whereby the object is rotated with the drive member, said means connecting the drive member to the object comprising a disc having a slot with an open end to accommodate a part, fastening means securing the disc to the drive member and locating the slot in the disc in side-by-side alignment with the slot in the drive member, and means mounted on the disc engageable with the object whereby rotation of the disc by the drive member will rotate the object.

2. The apparatus of claim 1 including: an elongated handle secured to a portion of the casing.

3. The apparatus of claim 1 including: a motor mounted on the casing, and means drivably connecting the motor to the power transmitting means.

4. The apparatus of claim 1 wherein: the drive member has an external spur type gear, said slot separating a portion of said gear, said power transmitting means including first and second gears positioned in driving engagement with separate portions of the spur type gear whereby at least one of the first or second gears drives the spur type gear so that the drive member is continuously rotated during operation of the motor.

5. The apparatus of claim 4 wherein: the power transmitting means includes a worm gear drivably connected to the motor, and a plurality of spur gears drivably connecting the worm gear to the first and second gears.

6. The apparatus of claim 1 wherein: the casing comprises a body having a chamber, a plate mounted on the body to enclose the chamber, said power transmitting means being located in said chamber.

7. The apparatus of claim 1 wherein: the drive member has cylindrical hubs, said casing comprising a body having a circular hole for receiving one hub and a plate secured to the body, said plate having a hole for receiving the other hub whereby the drive member is rotatably mounted on the body and plate.

8. The apparatus of claim 1 wherein: the power transmission means has at least one shaft adapted to be connected to the drive motor.

9. The apparatus of claim 1 wherein: the means engageable with the object comprise pins mounted on the disc, said pins adapted to project into holes in the object.

10. The apparatus of claim 9 including: sleeve members secured to the disc, said sleeve members accommodating the pins to mount the pins on the disc.

11. The apparatus of claim 9 including: means to adjustably mount the pins on the disc.

12. An apparatus for applying a rotational force to a coil spring connected to a collar, said collar having holes and being mounted on a shaft of a door counterbalancing structure comprising: a casing having a slot with an open end to accommodate the shaft, a rotatable drive member rotatably mounted on the casing, said drive member having a slot with an open end to accommodate the shaft, power transmitting means mounted on the casing for rotating the drive member, said power transmitting means adapted to be connected to a motor whereby on operation of the motor the power transmitting means rotates the drive member, and means connecting the drive member to the collar whereby the collar is rotated on said shaft to apply a rotational force to the coil spring, said means connecting the drive member to the collar comprising a disc having a slot with an open end to accommodate the shaft, fastening means securing the disc to the drive member and locating the slot in the disc in side-by-side alignment with the slot in the drive member, and means mounted on the disc engageable with the collar whereby the collar is rotated with the disc.

13. The apparatus of claim 12 including: an elongated handle secured to a portion of the casing.

14. The apparatus of claim 12 including: an electric motor mounted within the casing, and means drivably connecting the motor to the power transmitting means.

15. The apparatus of claim 12 wherein: the drive member has an external spur-type gear, said slot in the drive member separating a portion of said gear, said power transmitting means including first and second gears positioned in driving engagement with separate portions of the spur-type gear whereby at least one of the first or second gears drives the spur-type gear so that the drive member is continuously rotated during operation of the motor.

16. The apparatus of claim 15 wherein: the power transmitting means includes a worm gear drivably connected to the motor, and a plurality of spur gears drivably connecting the worm gear to the first and second gears.

17. The apparatus of claim 12 wherein: the casing comprises a body having a chamber, a plate mounted on the body to enclose the chamber, said power transmitting means being located in said chamber.

18. The apparatus of claim 12 wherein: the drive member has cylindrical hubs, said casing comprising a body having a circular hole for receiving one hub and a plate secured to the body, said plate having a hole for receiving the other hub whereby the drive member is rotatably mounted on the body and the plate.

19. The apparatus of claim 12 wherein: the power transmitting means has at least one shaft adapted to be connected to a drive member.

20. The apparatus of claim 12 wherein: the means engageable with the collar comprise pins mounted on the disc, said pins adapted to be projected into holes in the collar.

21. The apparatus of claim 20 including: sleeve members secured to the disc said sleeve members accommodating the pins to mount the pins on the disc.

22. The apparatus of claim 20 including: means to adjustably mount the pins on the disc.

23. An apparatus for applying a rotational force to a coil spring having a first end connected to a rotatable collar and a second end connected to a fixed anchor, said collar having a central hole and a side wall with a plurality of keyhole slots, a shaft extended through said spring and the hole in the collar, comprising: a casing having a slot with an open end to accommodate the shaft, a rotatable drive member rotatably mounted on the casing, said drive member having a slot with an open end locatable in transverse alignment with the slot in the casing to accommodate the shaft, power transmission means mounted on the casing for rotating the drive member, said power transmission means adapted to be connected to a motor whereby on operation of the motor the power transmission means rotates the drive member, a plurality of transversely projected bolts secured to the drive member, each of said bolts having a head adapted to be located in a keyhole slot in the side wall of the collar whereby the collar is rotated on said shaft to apply a rotational force to the coil spring on rotation of the drive member by operation of the motor.

24. The apparatus of claim 23 including: an electric motor mounted within the casing, and means drivably connecting the motor to the power transmitting means.

25. The apparatus of claim 24 wherein: the means drivably connecting the motor to the power transmitting means includes a worm gear drivably connected to the motor, said power transmitting means including a plurality of spur gears drivably connecting the worm gear to the drive member.

26. The apparatus of claim 23 wherein: the casing comprises a body having an elongated handle and a chamber, a plate mounted on the body to enclose the chamber, an electric motor mounted on the body within the chamber, means drivably connecting the motor to the power transmitting means, said power transmitting means being located in said chamber.

27. In combination, a power tool and a door counterbalancing structure comprising: a shaft, a fixed anchor located adjacent the shaft, a collar rotatably mounted on the shaft, means to secure the collar to the shaft, a coil spring having a first end connected to the collar and a second end fixed to the anchor, said power tool comprising a casing having a slot with an open end accommodating the shaft, a rotatable drive member rotatably mounted on the casing, said drive member having a slot with an open end locatable in transverse alignment with the slot in the casing to accommodate the shaft, power transmitting means mounted on the casing for rotating the drive member, said power transmitting means adapted to be connected to a motor whereby on operation of the motor the power transmitting means rotates the drive member, and means connecting the drive member to the collar whereby the collar is rotated relative to said shaft in response to rotation of the drive member by the motor to apply a rotational force to the coil spring to load the spring, said means to secure the collar to the shaft operable to fix the collar to the shaft after the spring is loaded whereby the rotational force of the spring is applied to the shaft.

28. The combination of claim 27 wherein: the power tool includes an elongated handle secured to a portion of the casing.

29. The combination of claim 27 wherein: the power tool includes an electric motor mounted within the casing, and means drivably connecting the motor to the power transmitting means.

30. The combination of claim 27 wherein: the power tool includes a drive member having an external spur-type gear, said slot in the drive member separating a portion of said gear, said power transmitting means including first and second gears positioned in driving engagement with separate portions of the spur-type gear whereby at least one of the first or second gears drives the spur-type gear so that the drive member is continuously rotated during operation of the motor.

31. The combustion of claim 27 wherein: the power transmitting means has a casing having a body surrounding a chamber, a plate mounted on the body to enclose the chamber, an electric motor mounted on the body and located within the chamber, means drivably connecting the electric motor to the power transmitting means, said power transmitting means being located in said chamber.

32. The combination of claim 27 wherein: the means connecting the drive member to the collar includes a disc, fastening means attaching the disc to the drive member, and pins mounted on the disc and projected into holes in the collar.

33. The combination of claim 32 wherein: the disc has a slot with an open end, said slot in the disc being located in side-by-side alignment with the slot in the drive member.

34. The combination of claim 32 including: sleeve members secured to the disc, said sleeve members accommodating the pins to mount the pins on the disc.

35. The combination of claim 32 including: means to adjustably mount the pins on the disc.

36. The combination of claim 27 wherein: the collar has a plurality of keyhole slots, said means connecting the drive means to the collar including means attached to the drive members having portions located in the keyhole slots to drivably connect the drive member to the collar.

* * * * *

UNITED STATES PATENT AND TRADEMARK OFFICE

CERTIFICATE OF CORRECTION

PATENT NO. : 3,979,977

DATED : September 14, 1976

INVENTOR(S) : Edward Dorma

It is certified that error appears in the above-identified patent and that said Letters Patent are hereby corrected as shown below:

Column 2, line 47, "and" should be --end--.

Column 10, line 8, "combustion" should be --combination--.

Signed and Sealed this

Twenty-first Day of December 1976

[SEAL]

*Attest:*

RUTH C. MASON
*Attesting Officer*

C. MARSHALL DANN
*Commissioner of Patents and Trademarks*